US006903502B2

(12) United States Patent
Kim

(10) Patent No.: US 6,903,502 B2
(45) Date of Patent: Jun. 7, 2005

(54) INNER SHIELD FOR COLOR CATHODE RAY TUBE

(75) Inventor: Hyung-Jin Kim, Gumi (KR)

(73) Assignee: Orion Electric Co., Ltd., Gumi (KR)

( * ) Notice: Subject to any disclaimer, the term of this patent is extended or adjusted under 35 U.S.C. 154(b) by 206 days.

(21) Appl. No.: 10/333,649

(22) PCT Filed: Jul. 24, 2001

(86) PCT No.: PCT/KR01/01263

§ 371 (c)(1),
(2), (4) Date: Jan. 21, 2003

(87) PCT Pub. No.: WO02/27748

PCT Pub. Date: Apr. 4, 2002

(65) Prior Publication Data

US 2003/0155855 A1 Aug. 21, 2003

(30) Foreign Application Priority Data

Jul. 24, 2000 (KR) ..... 2000-42375

(51) Int. Cl.[7] ..... H01J 31/00
(52) U.S. Cl. ..... 313/477 R; 313/364; 313/402
(58) Field of Search ..... 313/477 R, 364, 313/402, 479, 313, 326

(56) References Cited

U.S. PATENT DOCUMENTS 4,580,076 A 4/1986 Shimoma et al.
5,363,010 A * 11/1994 Van Mensvoort ..... 313/402
5,773,924 A * 6/1998 Nakamura ..... 313/402
6,229,254 B1 * 5/2001 Matsudate et al. ..... 313/402
6,768,253 B1 * 7/2004 Iwamoto et al. ..... 313/479

FOREIGN PATENT DOCUMENTS

| | | |
|---|---|---|
| JP | 5-159713 | 6/1993 |
| JP | 8-171866 | 7/1996 |
| JP | 11-149883 | 6/1999 |
| JP | 11-354040 | 11/1999 |
| KR | 92-13551 | 7/1992 |
| KR | 1999-005544 | 1/1999 |

* cited by examiner

*Primary Examiner*—Ashok Patel
*Assistant Examiner*—Anthony Canning
(74) *Attorney, Agent, or Firm*—Merchant & Gould P.C.

(57) ABSTRACT

The invention relates to an inner shield for color cathode ray tube. The inner shield has two long side parts and two short side parts. Each of two long sides has an opening part which comprises an inclined part and an U-shape recessed edge. Otherwise, the opening part may comprise an vertical part and an U-shape recessed edge. Each of two short sides has a V-shaped opening. The inner shield of the invention is capable of surely shielding unintended external magnetic field.

25 Claims, 21 Drawing Sheets

Fig. 11

( μm)

| Inner Shield | TL | | TR | | BL | | BR | | TC | | TC | |
|---|---|---|---|---|---|---|---|---|---|---|---|---|
| | H | V | H | V | H | V | H | V | H | V | H | V |
| I | 7.7 | 7.3 | 0.0 | -5.0 | -9.0 | 5.7 | 2.0 | -2.7 | 4.7 | -1.7 | -6.7 | -2.3 |
| A | 8.5 | 15.0 | -0.5 | -12.0 | -8.0 | 15.0 | -0.5 | -12.0 | 6.0 | -2.0 | -8.5 | -1.0 |
| B | 5.0 | 9.0 | 3.0 | -12.0 | -4.0 | 8.0 | 1.0 | -12.0 | 7.0 | -2.0 | -8.0 | -3.0 |
| C | 10.0 | 9.0 | 7.0 | -9.0 | -7.0 | 10.0 | -4.0 | -10.0 | 9.0 | -5.0 | -10.0 | -6.0 |

Fig. 12

( μm)

| Inner Shield | TL | | TR | | BL | | BR | | TC | | TC | |
|---|---|---|---|---|---|---|---|---|---|---|---|---|
| | H | V | H | V | H | V | H | V | H | V | H | V |
| I | -1.0 | -4.3 | -10.0 | 10.3 | -0.7 | -7.0 | 11.0 | 12.7 | -9.0 | 0.0 | 8.0 | -2.7 |
| A | -4.0 | -10.0 | -12.0 | 13.0 | -2.5 | -13.0 | 6.5 | 17.5 | -8.5 | -1.5 | 5.5 | -2.0 |
| B | -4.0 | -8.0 | -7.0 | 11.0 | -1.0 | -13.0 | 6.0 | 10.0 | -9.0 | -1.0 | 8.0 | -4.0 |
| C | -5.0 | -8.0 | -7.0 | 13.0 | 5.0 | -9.0 | 9.0 | 11.0 | -12.0 | -4.0 | 10.0 | -5.0 |

Fig. 13

( μm)

| Inner Shield | TL | | TR | | BL | | BR | | TC | | TC | |
|---|---|---|---|---|---|---|---|---|---|---|---|---|
| | H | V | H | V | H | V | H | V | H | V | H | V |
| I | 7.3 | 4.3 | -9.0 | 3.7 | -7.7 | 2.0 | 10.3 | 8.7 | -3.0 | -4.3 | 0.0 | -5.3 |
| A | 7.0 | 3.5 | -8.5 | 1.5 | -9.0 | 1.5 | 9.5 | 5.5 | -2.5 | -4.0 | -0.5 | -2.5 |
| B | 3.0 | 0.0 | -5.0 | -2.0 | -4.0 | -3.0 | 4.0 | -2.0 | -2.0 | -7.0 | -1.0 | -7.0 |
| C | 3.0 | 3.0 | -4.0 | 1.0 | -4.0 | 0.0 | 5.0 | 2.0 | -1.0 | -11.0 | -1.0 | -10.0 |

INNER SHIELD FOR COLOR CATHODE RAY TUBE

TECHNICAL FIELD

The present invention relates to an inner shield for color cathode ray tube. In particular, the present invention relates to an inner shield for color cathode ray tube, which effectively shields the effect of the external magnetic field on electron beams within the cathode ray tube and thus prevents the degradation of color purity. Resultantly, high quality images may be obtained.

BACKGROUND ART

Generally, in a color cathode ray tube, if any unwanted magnetic field from terrestrial magnetism or external circuits enters the passing zone of three electron beams of three primary colors, blue (B), green (G), and red (R), the three electron beams tend to break away from their original tracks due to the effect of the unwanted magnetic field. This is called miss-landing. The miss-landing causes the degradation of color purity in a color cathode ray tube. For this reason, color cathode ray tubes ordinarily contain an inner shield of a magnetic shielding material inside of the funnel where the three electron beams are easily affected by magnetic fields.

The inner shield has the basic structure of the hollow shape. However, such basic structure may not shield external magnetic fields sufficiently. Therefore, further developed inner shields with various shapes and structures have been introduced to shield external magnetic field more appropriately.

For example, Korea Patent Application No. 1997-029742 discloses an inner shield for color cathode ray tube. As illustrated in FIG. 1, the inner shield 10 comprises long side parts 15, short side parts 17 and corner parts 19, which form the large opening part 11 and the small opening part 13. The long side parts 15 and the short side parts 17 are inclined towards the direction of the tube axis Z. At the small opening part 13's side of the long side parts 15 and the short side parts 17, the triangular extension members 151, 171 are connected respectively as one body. Also, at the small opening part 13's side of the corner parts 19 between the long side parts 15 and the short side parts 17, the extension members 191 are connected. In the long side parts 15 and short side parts 17, the triangular notches 153 and 173 are formed respectively. The notches 193 are also formed in the corner parts 19. Here, the extension members 151 and notches 153 are for concentrating magnetic flux at the long side parts 15. Also, the extension members 171 and notches 173 are for concentrating magnetic flux at the short side parts 17. Furthermore, the extension members 191 and notches 193 are for concentrating magnetic flux at corner parts 19.

Japanese Patent Laid-Open No. Hei 5-159713 also introduces an inner shield. As illustrated in FIG. 2*a*, FIG. 2*b*, and FIG. 2*c*, the inner shield 20 comprises long side parts 23 and short side parts 24, which form the large opening part 21 and the small opening part 22. On the small opening part 22's side of the long side parts 23 and the short side parts 24, recessed parts 29 and 30 are formed respectively. At the four diagonal points of the small opening part 22, the recessed part 29 makes an angle $\theta_v$ with respect to the center axis 25 of the long side part 23. The recessed part 30 also makes an angle $\theta_v$ with respect to the center axis 26 of the short side part 24. The depth of the recessed parts 29 and 30 is $H_D$-$H_V$.

Additionally, Japanese Patent Laid-Open No. Hei 11-354040 also introduces an inner shield. As illustrated in FIG. 3, the inner shield 40 comprises long side parts 43 and short side parts 44 to form the large opening part 41 and the small opening part 42. At the four diagonal points 45 of the small opening part 42, the recessed parts 46 and 47 are formed on the long side parts 43 and the short side parts 44, respectively. At the point 45, the recessed part 46 makes an angle $\alpha$ with respect to the center axis 48 of the long side part 43. The recessed part 47 makes an angle $\beta$ with respect to the center axis 49 of the short side part 44 at the point 45. The long side part 43 makes an angle $\delta$ from the bottom surface of the large opening part 41 and the short side part 44 makes an angle $\delta$ from bottom surface of the large opening part 41. The diagonal axis 50 makes an angle $\epsilon$ to the surface of the large opening part 41. The edge 51 of the diagonal axis 50 at the small opening part 42 side makes an angle $\epsilon'(\leqq\epsilon)$ to the surface with the depth d1 or d2 at a right angle to the tube axis Z. The surface with the depth d1, d2 at a right angle to the tube axis Z forms the angle $\delta'(\leqq\delta)$ to the long side parts 43 and the short side parts 44.

Notwithstanding the various shapes and structures of the conventional inner shields, the unwanted magnetic field from terrestrial magnetism or external circuits has not been sufficiently shielded from entering the electron beam passing zone of the color cathode ray tube and miss-landing has frequently occurred. Consequently, the color purity was degraded and it was difficult to obtain high quality images.

DISCLOSURE OF INVENTION

The purpose of the present invention is to provide an inner shield of a color cathode ray tube, which prevents miss-landing by effectively shielding unwanted electronic field generated from the terrestrial magnetism or external circuits and thus by reducing the path changes of electron beams.

Another purpose of the present invention is to provide an inner shield of a color cathode ray tube, which prevents the degradation of color purity and provides high quality images.

Another purpose of the present invention is to provide an inner shield of a color cathode ray tube, which improves the manufacture and processing efficiency, and the mass productivity.

In order to achieve the above mentioned purposes of the present invention, the inner shield of a color cathode ray tube according to the preferred implementation of the present invention comprises two long side parts facing each other and two short side parts facing each other, which form a small opening part at a electron gun's side and a large opening part at a panel's side.

The present invention, further comprises a plurality of first recessed parts recessed for a given depth at one or more slopes from each of diagonal points of said long side parts at a small opening part's side towards a large opening part's side of said long side parts; and a plurality of second recessed parts recessed for a given depth in a round shape in connection with said first recessed parts, wherein said slopes are corresponding to the ratio of a length of said first recessed parts in the direction of center axis of said long side parts to a length of said first recessed parts at the right angle to center axis of said long side parts.

Preferably, the absolute value of said slopes become smaller as said first recessed parts become far from said small opening part's side of said long side parts and close to said large opening part's side of said long side parts.

Preferably, each of said first recessed parts may be composed of a first inclined part with a first slope and a second inclined part with a second slope, an absolute value of said second slope is smaller than that of said first slope. Said first slope of said first inclined part has an infinite value.

Preferably, said second recessed parts may be in a U-shape.

Preferably, the present invention further comprises a plurality of third recessed parts recessed for a given depth at a third slope from each of diagonal points of said short side parts at said small opening part's side towards said large opening part's side of said short side parts, wherein said third slope is the ratio of a length of said third recessed part in the direction of center axis of said short side parts to a length of said third recessed part at the right angle to center axis of said short side parts; and a plurality of fourth recessed parts recessed at a fourth slope of 0 in connection with said third recessed parts, wherein said third and fourth slopes are ratios of a length of said third and fourth recessed parts in the direction of center axis of said short side parts to a length of said third and fourth recessed parts at the right angle to center axis of said short side parts.

Preferably, said third slope of said third recessed parts may be determined to be an infinite value.

Preferably, the present invention may comprise said third recessed parts recessed in a V-shape from each of diagonal points of said short side parts at said small opening part's side towards said short side part's large opening part's side.

Preferably, each of pointed parts of said third recessed parts at said large opening part's side has a given curvature.

BRIEF DESCRIPTION OF DRAWINGS

FIG. 11 is a table showing the landing changes in the case that the inner shield of the present invention and the conventional inner shield are turned to the northern direction.

FIG. 12 is a table showing the landing changes in the case that the inner shield of the present invention and the conventional inner shield are turned to the southern direction.

FIG. 13 is a table showing the landing changes in the case that the inner shield of the present invention and the conventional inner shield are turned to the western direction.

BEST MODE FOR CARRYING OUT THE INVENTION

Reference will now be made in detail to the inner shield for color cathode ray tube according to the preferred embodiments of the present invention as illustrated in the accompanying drawings.

Figure 4:
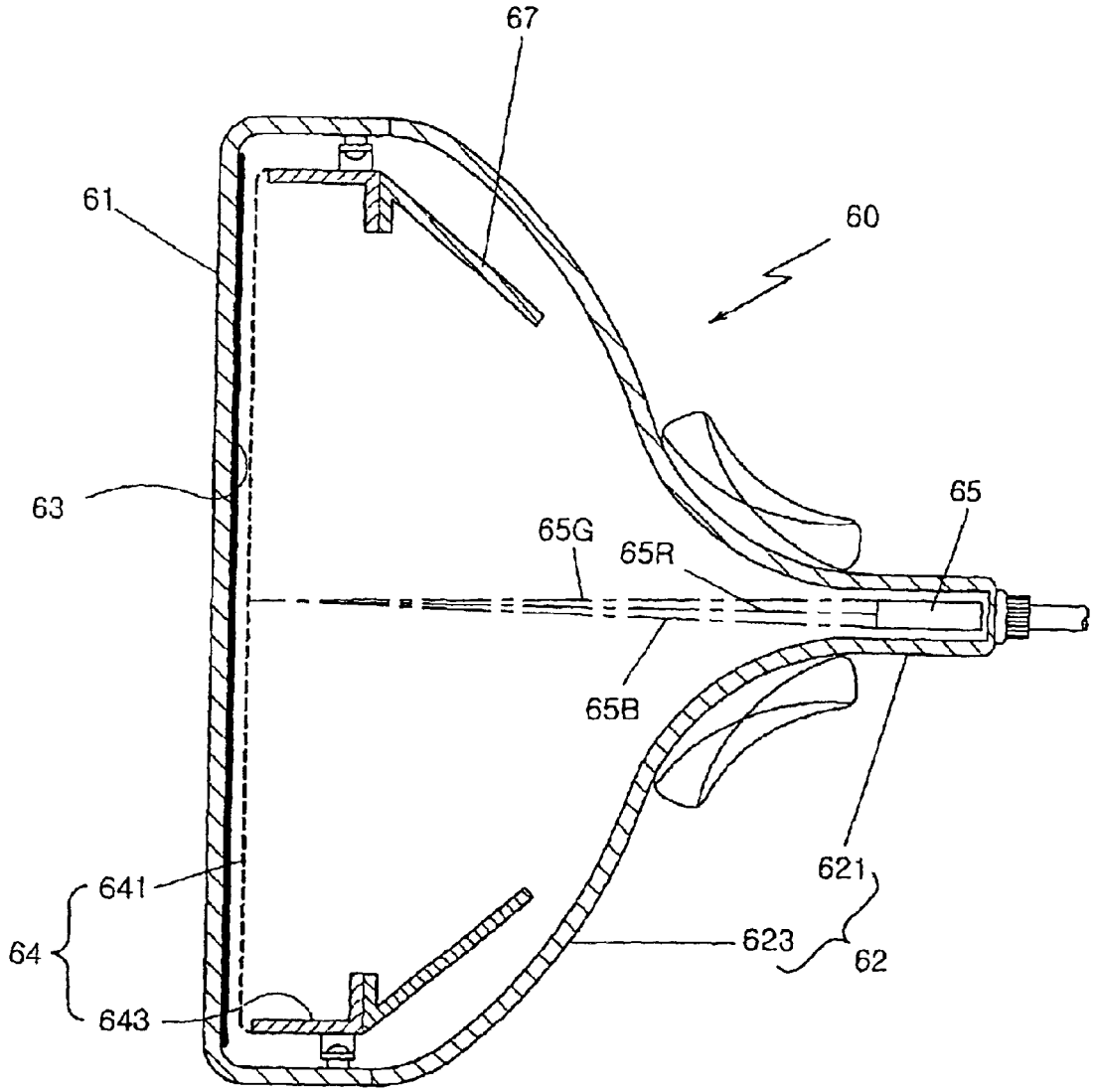
FIG. 4 is a diagram illustrating a color cathode ray tube in which the inner shield for color cathode ray tube according to the present invention is applied.

FIG. 4 is a diagram illustrating a color cathode ray tube in which the inner shield for color cathode ray tube according to the present invention is applied.

Figure 1:
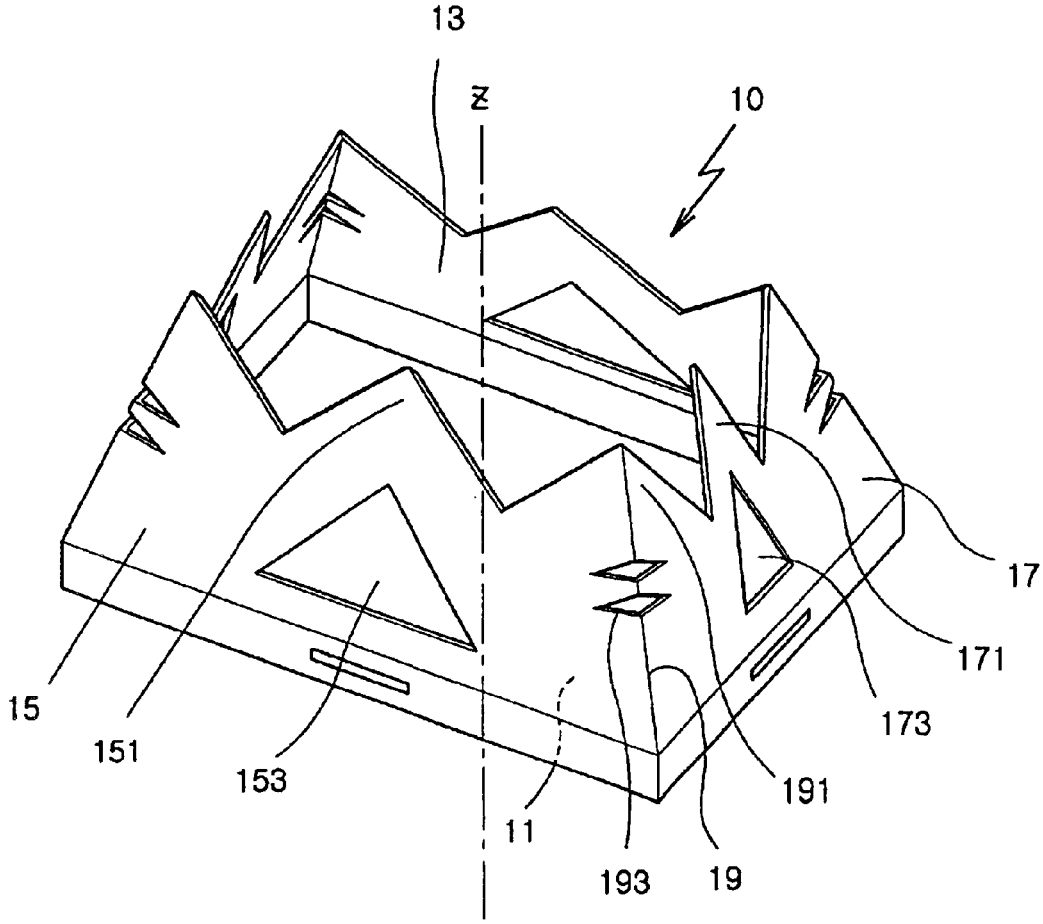
Fig. 1 Prior Art
FIG. 1 is a diagram illustrating an inner shield for color cathode ray tube according to the conventional technology.
Figure 2A:
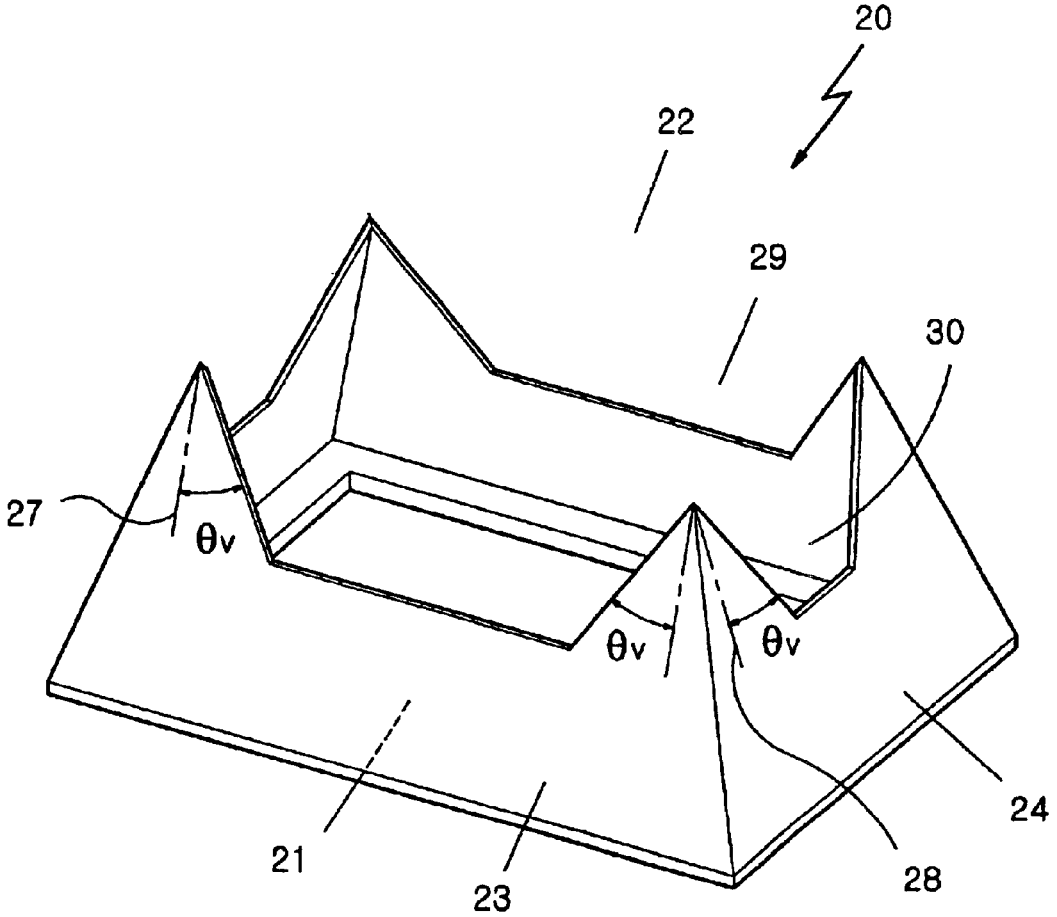
Fig. 2a Prior Art
FIG. 2*a* is a diagram illustrating another inner shield for color cathode ray tube according to the conventional technology.
Figure 2B:
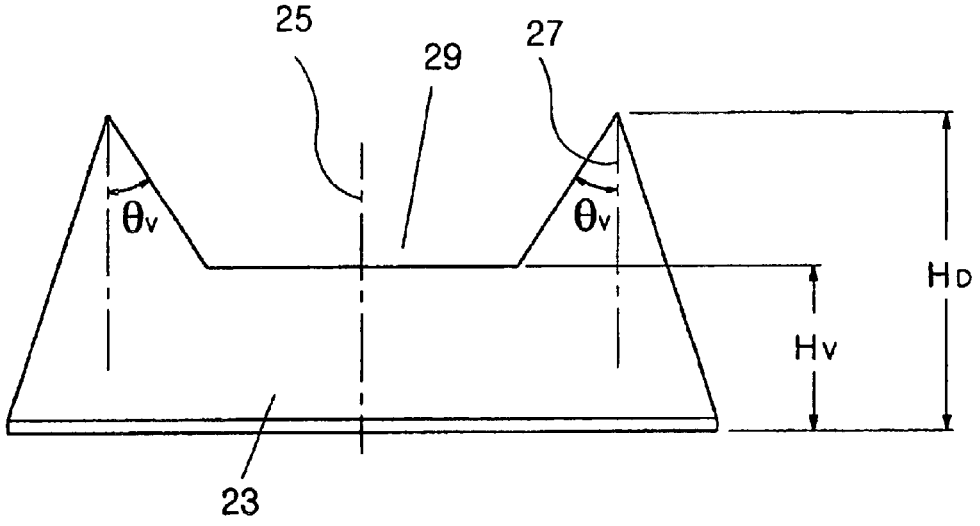
Fig. 2b Prior Art
FIG. 2*b* is a diagram illustrating a long side part of the inner shield illustrated in FIG. 2*a*.
Figure 2C:
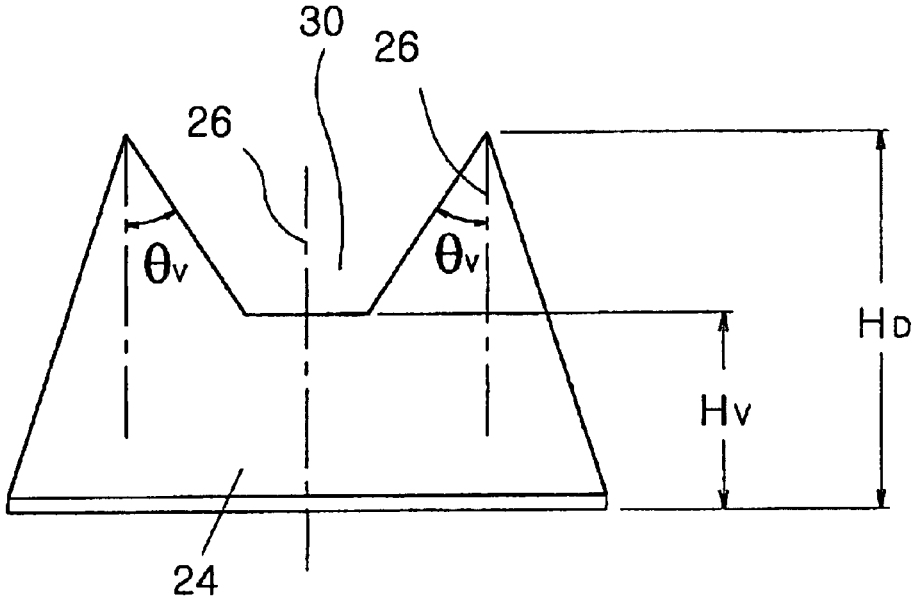
Fig. 2c Prior Art
FIG. 2*c* is a diagram illustrating a short side part of the inner shield illustrated in FIG. 2*a*.
Figure 3A:
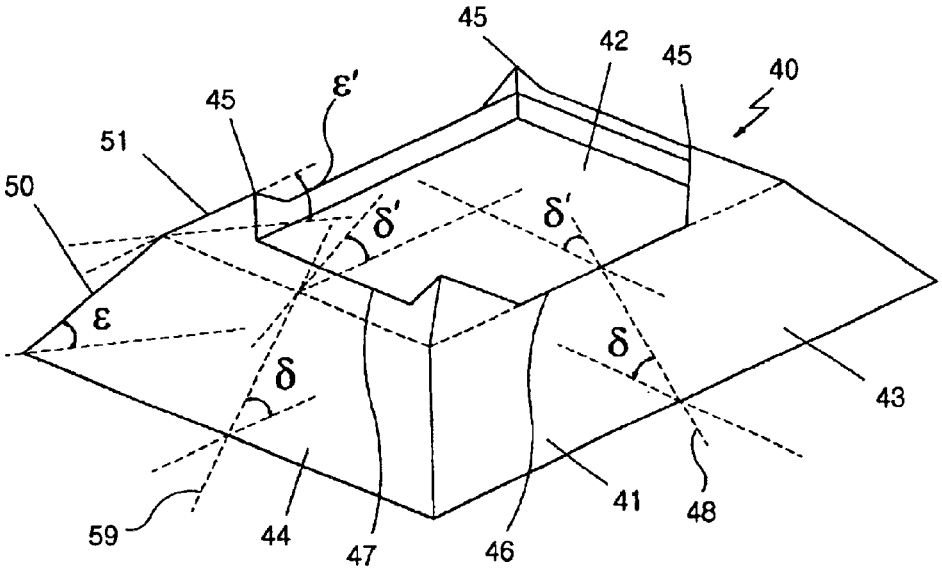
Fig. 3a Prior Art
FIG. 3*a* is a diagram illustrating still another inner shield for color cathode ray tube according to the conventional technology.
Figure 3B:
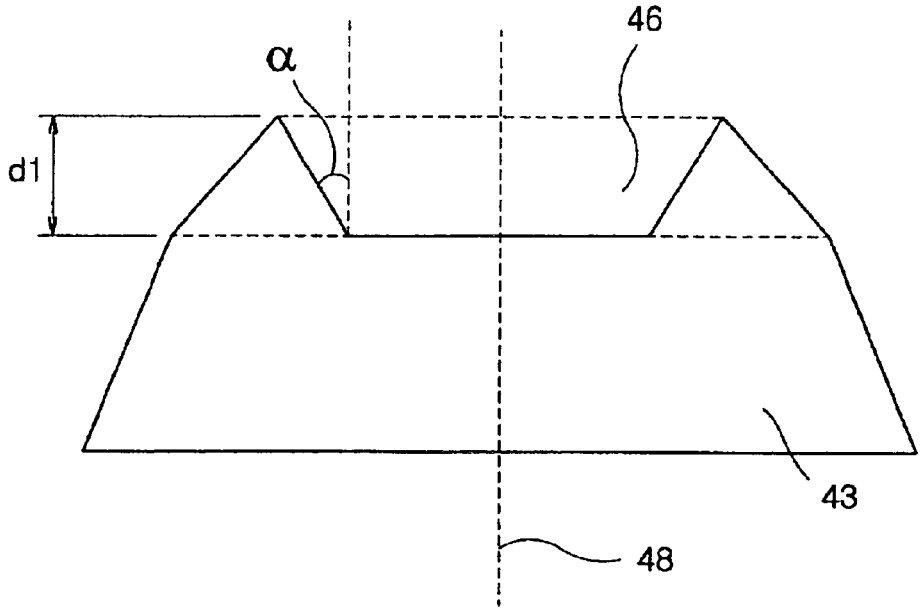
Fig.3b Prior Art
FIG. 3*b* is a diagram illustrating a long side part of the inner shield illustrated in FIG. 3*a*.
Figure 3C:
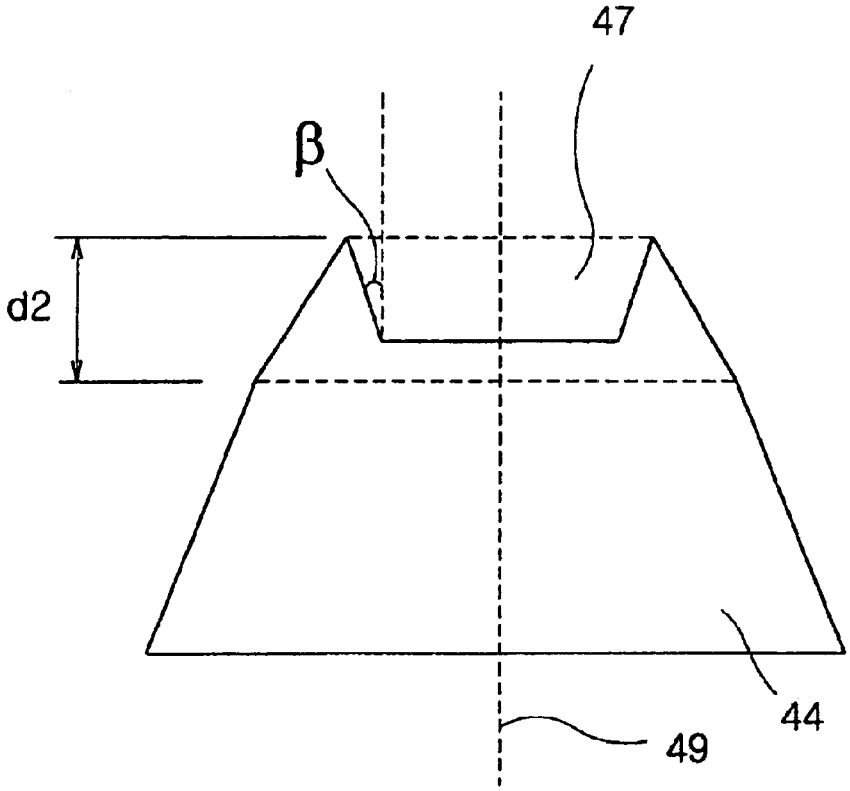
Fig. 3c Prior Art
FIG. 3*c* is a diagram illustrating a short side part of the inner shield illustrated in FIG. 3*a*.

Referring to FIG. 2, the color cathode ray tube 60 has the panel 61 of the glass material and the funnel 62 of the glass material attached to the panel 61 as one body. On the inner surface of the panel 61 is provided the fluorescent screen 63 composed of fluorescent layers of the three colors, red, blue and green. Facing the fluorescent screen 63, the shadow mask 64 is located inside of the panel 61. The shadow mask 64 is composed of the mask main body 641 in which electron beam passing holes are formed and the frame 643 attached around the mask main body 641. In the neck 621 of the funnel 62, the electron gun 65 emitting three electron beams 65R, 65G, 65B is located. The deflection yoke 66 is installed outside of the boundary between the neck 621 and the body part 623 of the funnel 62. The inner shield 67, which shields the electron beams 65R, 65G, 65B emitted from the electron gun 65 from the unwanted magnetic field resulting from terrestrial magnetism or external circuits, is located inside of the funnel 62.

Figure 5A:
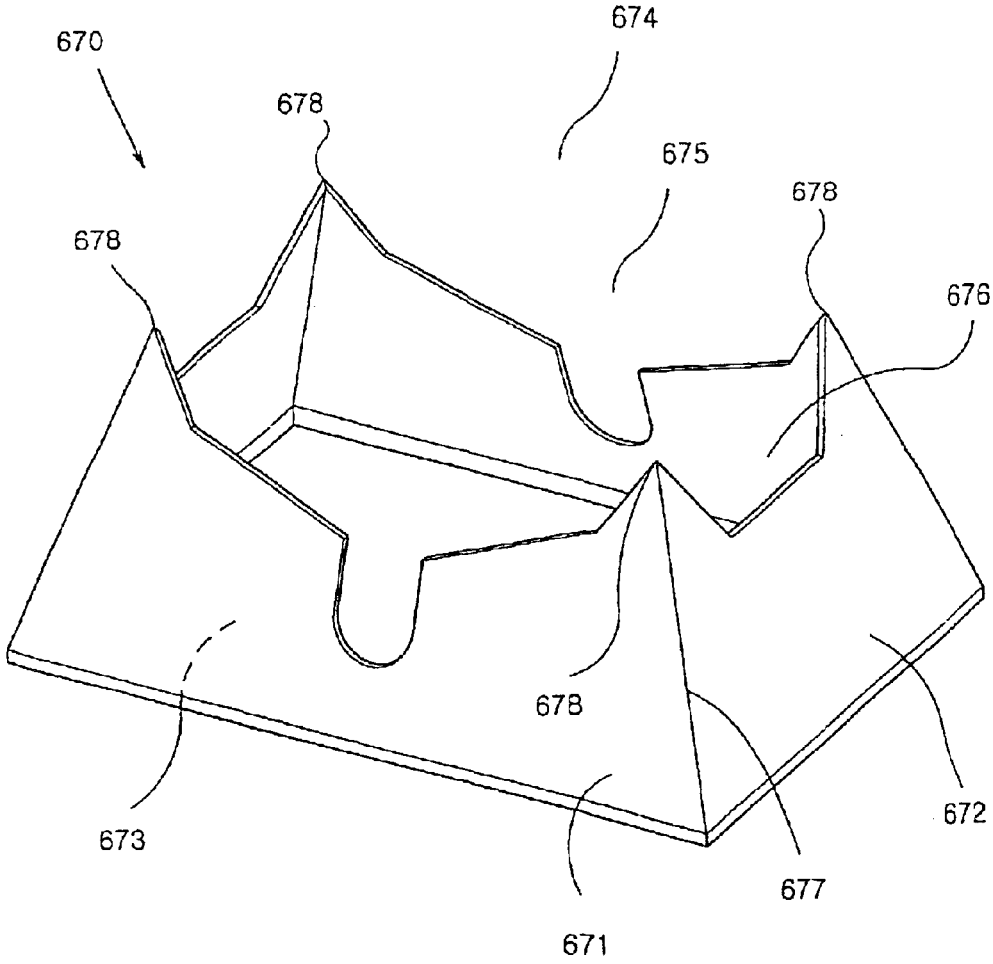
FIG. 5*a* is a diagram illustrating an inner shield for color cathode ray tube according to the first preferred embodiment of the present invention.
Figure 5B:
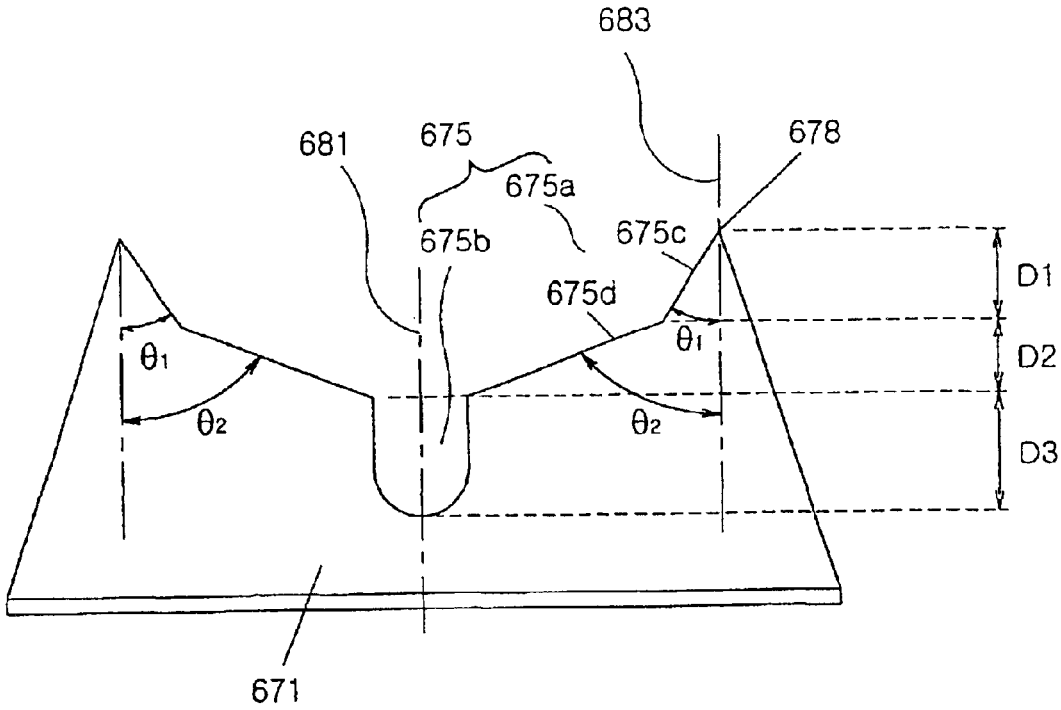
FIG. 5*b* is a diagram illustrating a long side part of the inner shield of FIG. 5*a*.
Figure 5C:
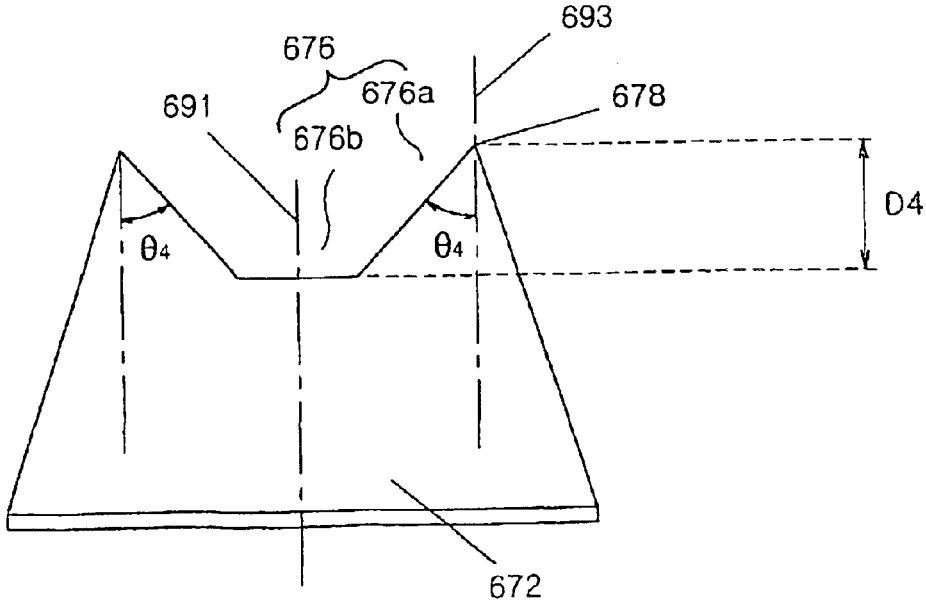
FIG. 5*c* is a diagram illustrating a short side part of the inner shield of FIG. 5*a*.

FIG. 5*a* is a diagram illustrating an inner shield for color cathode ray tube according to the first preferred embodiment of the present invention. FIG. 5*b* is a diagram illustrating a long side part of the inner shield of FIG. 5*a*. FIG. 5*c* is a diagram illustrating a short side part of the inner shield of FIG. 5*a*.

Referring to FIG. 5*a*, FIG. 5*b*, and FIG. 5*c*, the inner shield 670 according to the first preferred embodiment of the present invention is a hollow body comprising two long side parts 671 facing each other and two short side parts 672 facing each other. The large opening part 673 of the hollow body—the large opening part to face the shadow mask 64 shown in FIG. 4—is created in the shape of a large rectangular form. The small opening part 674 of the hollow body—the small opening part to face the electron gun 65 shown in FIG. 4—is created in the shape of a small rectangular form. The recessed parts 675 to concentrate magnetic flux on the long side parts 671 are created on the small opening part 674's side of the long side parts 671 respectively. The recessed parts 676 to concentrate magnetic flux on the corner parts 677 between the long side parts 671 and the short side parts 672 are created on the small opening part 674's side of the short side parts 672 respectively.

The recessed parts 675 of the long side parts 671 comprise the first recessed parts 675*a* and the second recessed parts 675*b*. The first recessed part 675*a* may contain two inclined parts, the first inclined part 675*c* and the second inclined part 675*d* for example. The first inclined part 675*c* of the said first recessed part 675*a* is recessed for the first depth $D_1$ at the first slope from the four points 678 of the long side part 671 at the small opening part 674's side towards the large opening part 673 of the relevant long side part 671. The second inclined part 675*d* of the first recessed part 675*a* is recessed for the second depth $D_2$ at the second slope which is smaller than the first slope in connection with the first inclined part 675*c* of the first recessed part 675*a*.

Here, the first and second slope is the absolute value of the ratio of the length of the first and second inclined part 675*c*, 675*d* from the relevant point 678 at the right angle to the long side part 671's center axis 681 i.e., the horizontal component of the first and second inclined part to the length of the first and second inclined part 675*c*, 675*d* in the direction parallel to the long side part 671's center axis 681 i.e., the vertical component of the first and second inclined part. The angles $\theta_1$, $\theta_2$ are the angles with respect to the axis 683 at the points 678 and are greater than 0 degree and smaller than 90 degrees. $\theta_2$ is greater than $\theta_1$.

The second recessed part 675*b* is recessed for the third depth $D_3$ towards the large opening part 673 of the long side part 671 in connection with the second inclined part 675*d* of the first recessed part 675*a* in a round shape for example, U-shape. The U-shaped second recessed part 675*b* is formed to concentrate more magnetic flux on the long side part 671 than on the short side part 672.

The first recessed part 675*a* is illustrated to have two inclined parts 675*c* and 675*d* for the convenience of explanation. However, it is apparent that the first recessed part may actually have three or more inclined parts.

The recessed part 676 of the short side part 672 is composed of the third recessed part 676*a* and the fourth recessed part 676*b*. The third recessed part 676*a* is recessed for the fourth depth $D_4$ at the third slope from the four points of the short side part 672 at the small opening part 674's side towards the large opening part 673 of the relevant short side part 672. The fourth recessed part 676*b* is recessed at the fourth slope of the value 0 in connection with the third recessed part 676*a*.

Here, the third and fourth slope is the absolute value of the ratio of the length of the third and fourth recessed part 676*a*, 676*b* from the relevant points 678 at the right angle to the short side part 672's center axis 691 i.e., the horizontal component of the third and fourth recessed part to the length of the third and fourth recessed part 676*a*, 676*b* in the direction 693 parallel to the long side part 672's center axis 691 i.e., the vertical component of the third and fourth recessed part. The angle $\theta_4$ is the angle with respect to the axis 693 at the points 678 and is greater than 0 degree and smaller than 90 degrees.

Here, it is preferable that the depth of the long side part 671's recessed part 675 i.e., the sum of the first depth $D_1$, the second depth $D_2$ and the third depth $D_3$ is in the range of 50 to 70% of the height of the long side part 671. Also, it is preferable that the depth of the short side part 672's recessed part 676, the fourth depth $D_4$, is in the range of 20 to 40% of the height of the short side part 672.

Figure 6A:
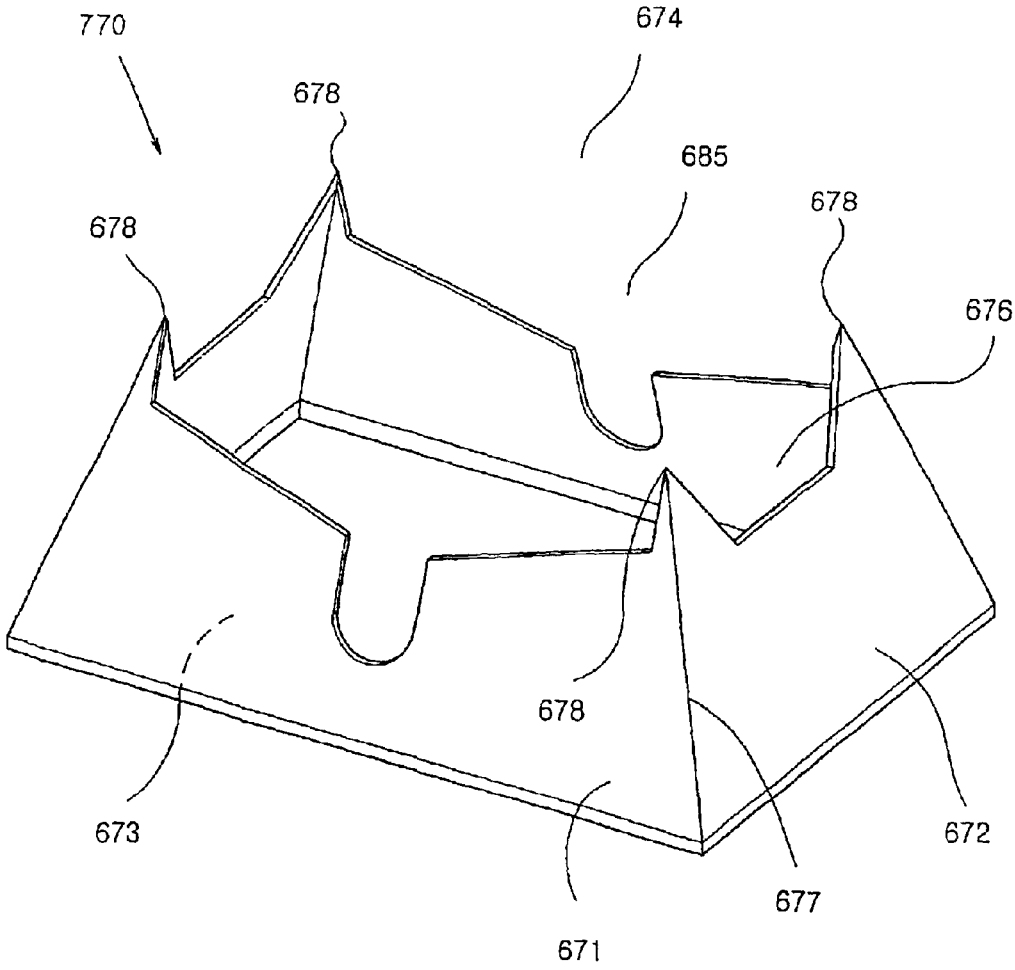
FIG. 6*a* is a diagram illustrating an inner shield for color cathode ray tube according to the second preferred embodiment of the present invention.
Figure 6B:
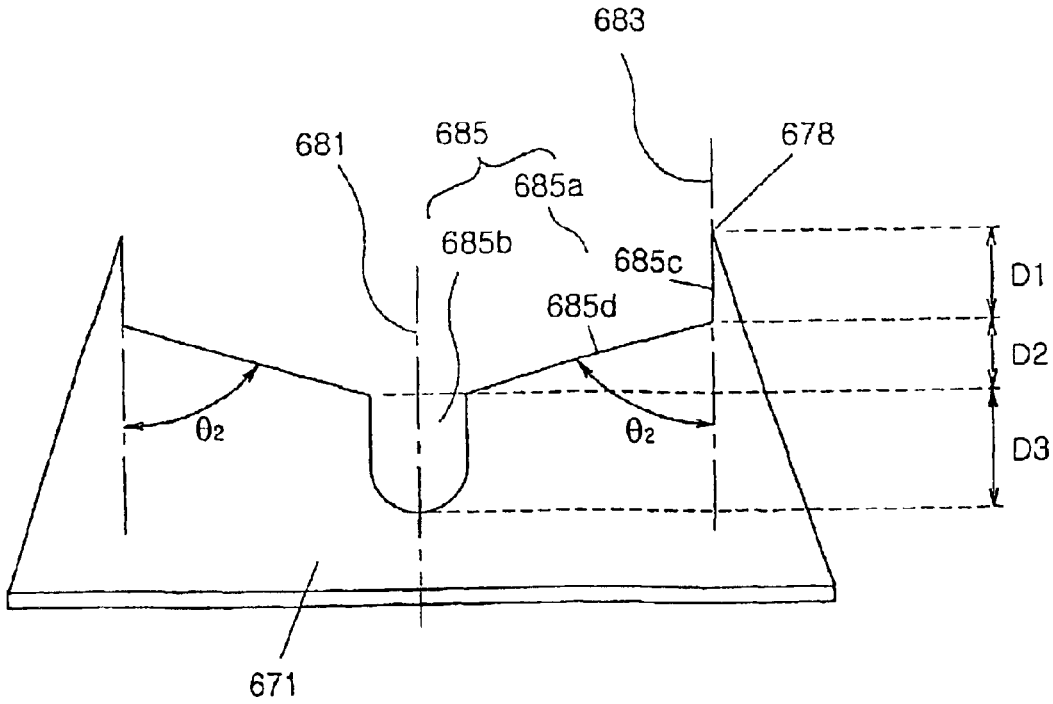
FIG. 6*b* is a diagram illustrating a long side part of the inner shield of FIG. 6*a*.
Figure 6C:
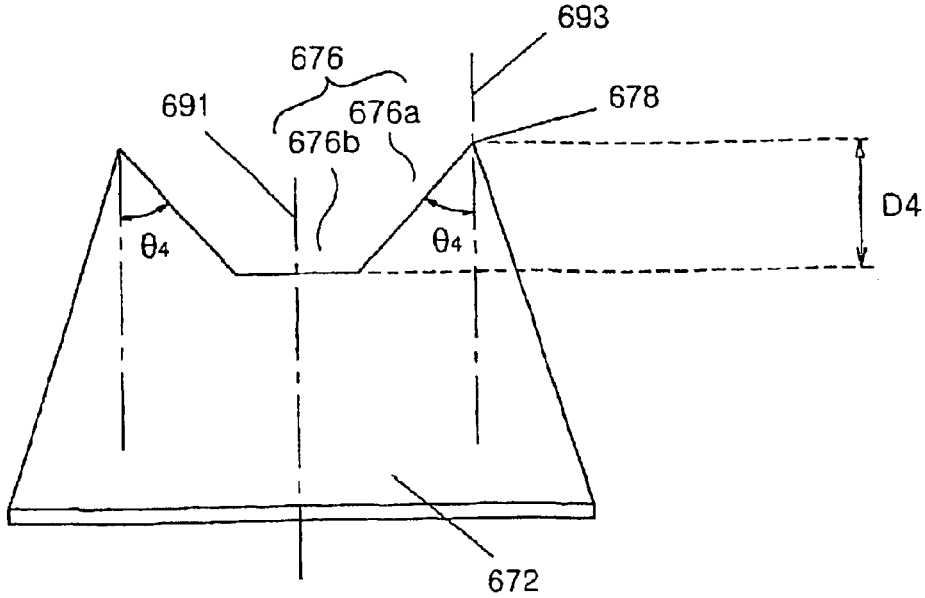
FIG. 6*c* is a diagram illustrating a short side part of the inner shield of FIG. 6*a*.

FIG. 6*a* is a diagram illustrating an inner shield for color cathode ray tube according to the second preferred embodiment of the present invention. FIG. 6*b* is a diagram illustrating a long side part of the inner shield of FIG. 6*a*. FIG. 6*c* is a diagram illustrating a short side part of the inner shield of FIG. 6*a*. The same codes are assigned to the parts that are same as those in the first preferred embodiment of the present invention in their structures and functions.

Referring to FIG. 6*a*, FIG. 6*b* and FIG. 6*c*, the inner shield 770 according to the second preferred embodiment of the invention has the recessed part 685 modified from the long side part 671's recessed part 675 of the first preferred embodiment of the present invention and has the same recessed part 676 of the short side part 672 as the first preferred embodiment. The recessed part 685 of the long side part 671 is composed of the first recessed part 685*a* and the second recessed part 685*b*. The first recessed part 685*a* contains two inclined parts, the first inclined part 685*c* and the second inclined part 685*d* for example. The first inclined part 685*c* of the first recessed part 685*a* is recessed for the first depth $D_1$ at the first slope from the four points 678 of the long side part 671 at the small opening part 674's side towards the large opening part 673 of the relevant long side part 671. The second inclined part 685*d* of the first recessed part 685*a* is recessed for the second depth $D_2$ at the second slope which is smaller than the first slope in connection with the first inclined part 685*c* of the first recessed part 685*a*.

Here, the first and second slope is the absolute value of the ratio of the length of the first and second inclined part 685*c*, 685*d* from the relevant point 678 at the right angle to the long side part 671's center axis 681 i.e., the horizontal component of the first and second inclined part to the length of the first and second inclined part 685*c*, 685*d* in the direction parallel to the long side part 671's center axis 681 i.e., the vertical component of the first and second inclined part. The first slope of the first inclined part 685 has the infinite value. The angle $\theta_2$ is the angle with respect to the axis 683 at the points 678 and is greater than 0 degree and smaller than 90 degrees. The corresponding angle of the first inclined part 685*c* is 0 degree.

The second recessed part 685*b* is recessed for the third depth $D_3$ towards the large opening part 673 of the long side part 671 in connection with the second inclined part 685*d* of the first recessed part 685*a* in a round shape for example, U-shape. The U-shaped second recessed part 685*b* is formed to concentrate more magnetic flux on the long side part 671 than to the short side part 672.

On the other hand, the short side part 672's recessed part 676 is composed of the third recessed part 676*a* and the fourth recessed part 676*b*. The third and fourth recessed parts 676*a*, 676*b* are structured in the same way as the third and fourth recessed parts of the first preferred embodiment of the present invention. Thus, the detailed explanation of the third and fourth recessed parts 676*a*, 676*b* is omitted in this part.

Figure 7A:
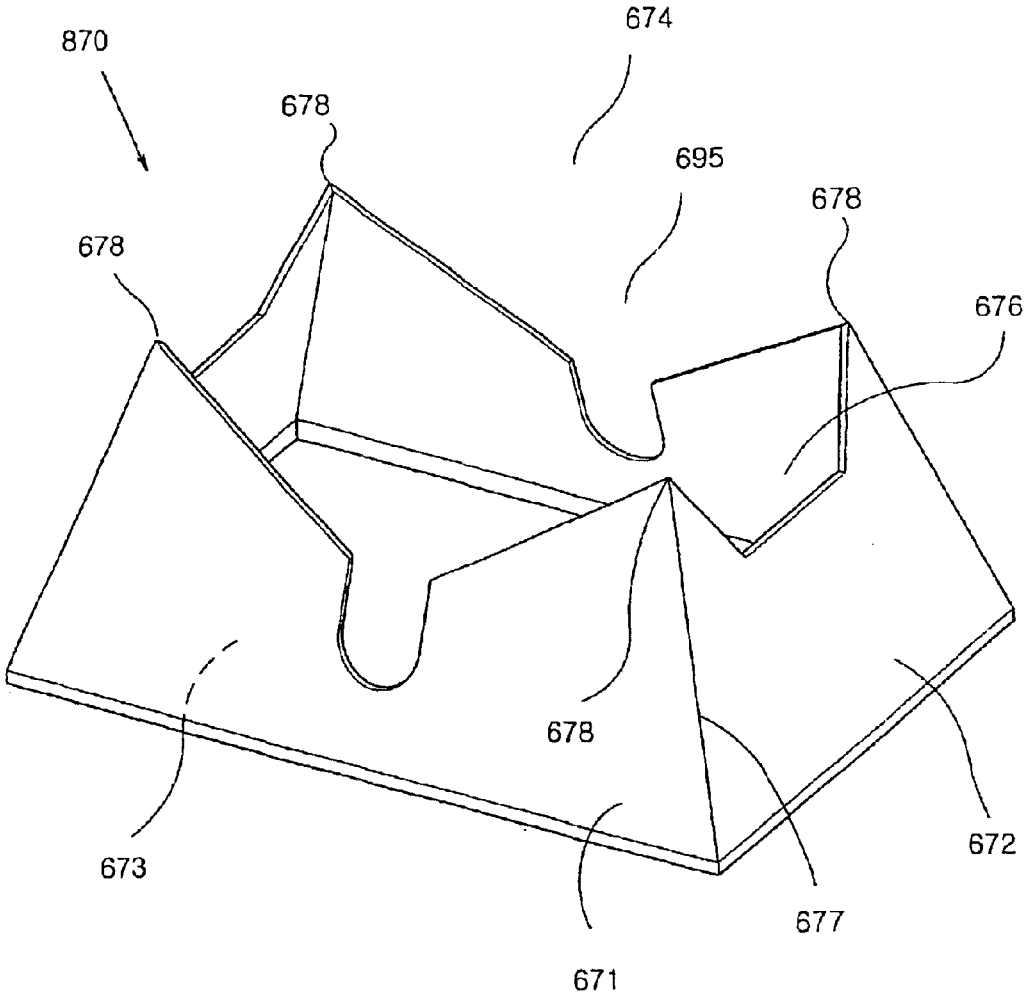
FIG. 7*a* is a diagram illustrating an inner shield for color cathode ray tube according to the third preferred embodiment of the present invention.
Figure 7B:
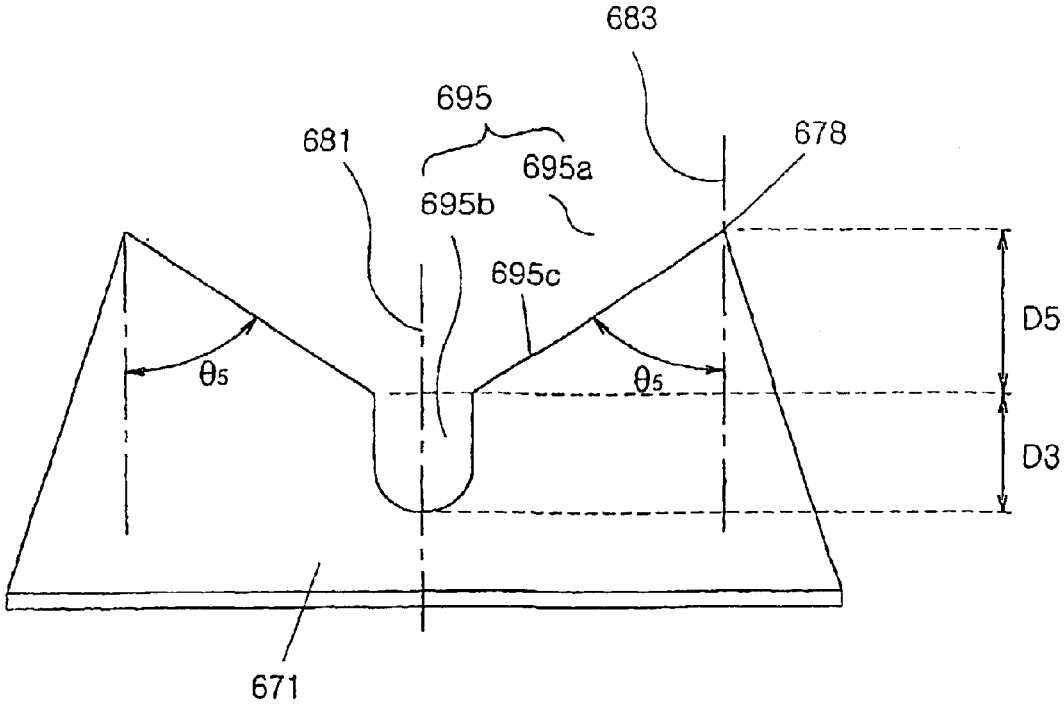
FIG. 7*b* is a diagram illustrating a long side part of the inner shield of FIG. 7*a*.
Figure 7C:
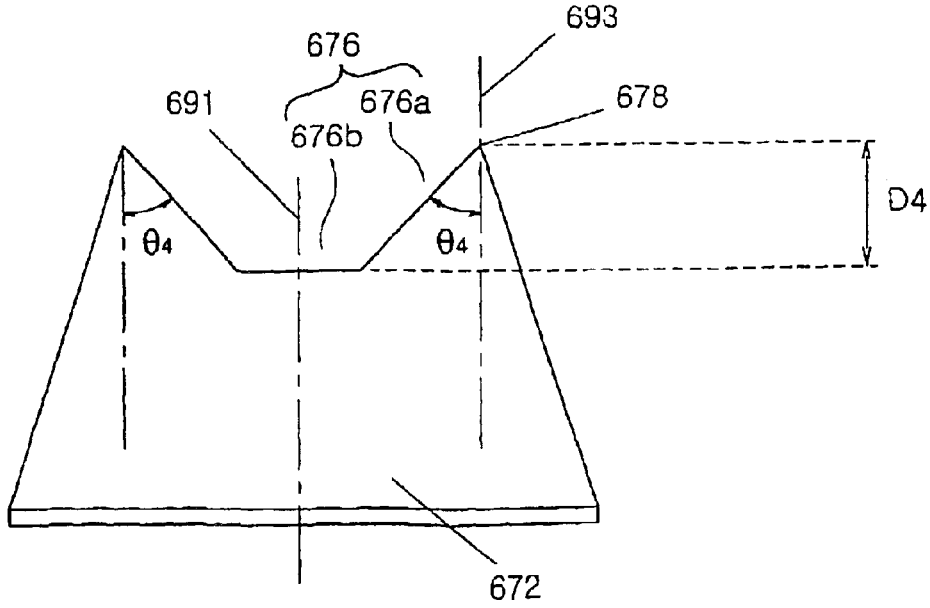
FIG. 7*c* is a diagram illustrating a short side part of the inner shield of FIG. 7*a*.

FIG. 7*a* is a diagram illustrating an inner shield for color cathode ray tube according to the third preferred embodiment of the present invention. FIG. 7*b* is a diagram illustrating a long side part of the inner shield of FIG. 7*a*. FIG. 7*c* is a diagram illustrating a short side part of the inner shield of FIG. 7*a*. The same codes are assigned to the parts that are same as those in the first preferred embodiment of the present invention in their structures and functions.

Referring to FIG. 7*a*, FIG. 7*b* and FIG. 7*c*, the inner shield 870 according to the third preferred embodiment of the present invention has the recessed part 695 modified from the long side part 671's recessed part 675 of the first preferred embodiment of the present invention and has the same recessed part 676 of the short side part 672 as the first preferred embodiment of the present invention. The recessed part 695 of the long side part 671 is composed of the first recessed part 695*a* and the second recessed part 695*b*. The first recessed part 695*a* contains only one inclined part—the first inclined part 695*c*. The first inclined part 695*c* of the first recessed part 695*a* is recessed for the fifth depth $D_5$ at the first slope from the four points 678 of the long side part 671 at the small opening part 674's side towards the large opening part 673 of the relevant long side part 671.

Here, the first slope is the absolute value of the ratio of the length of the first inclined part 695*c* from the relevant point 678 at the right angle to the long side part 671's center axis 681 i.e., the horizontal component of the first inclined part to the length of the first inclined part 695*c* in the direction 683 parallel to the said long side part 671's center axis 681 i.e., the vertical component of the said first inclined part. The angle $\theta_5$ is the angle with respect to the axis 683 at the points 678 and is greater than 0 degree and smaller than 90 degrees.

The second recessed part 695*b* is recessed for the third depth $D_3$ towards the large opening part 673 of the long side part 671 in connection with the first inclined part 695*c* of the first recessed part 695*a* in a round shape for example, U-shape. The U-shaped second recessed part 695*b* is formed to concentrate more magnetic flux on the long side part 671 than to the short side part 672. Here, it is preferable that the depth of the long side part 671's recessed part 695 i.e. the sum of the fifth depth $D_5$ and the third depth $D_3$ is in the range of 50 to 70% of the height of the long side part 671.

On the other hand, the short side part 672's recessed part 676 is composed of the third recessed part 676*a* and the fourth recessed part 676*b*. The third and fourth recessed parts 676*a*, 676*b* are structured in the same way as the third and fourth recessed parts of the first preferred embodiment of the present invention. Thus, the detailed explanation of the third and fourth recessed parts 676*a*, 676*b* is omitted in this part.

As described above, the inner shields according to the first, second and third embodiment of the present invention comprise the first recessed part at the long side part's small opening part's side with one or more slopes and the second recessed part of the U-shape in connection with the first recessed part. As a result, the inner shield of the present invention may cause unwanted magnetic field arising from the terrestrial magnetism or external circuits to concentrate at the long side parts and corner parts rather than at the short side parts. Therefore, the unwanted magnetic field arising from the terrestrial magnetism or external circuits may sufficiently be shielded within the electron beams' passing zone in the inner shield.

Figure 8A:
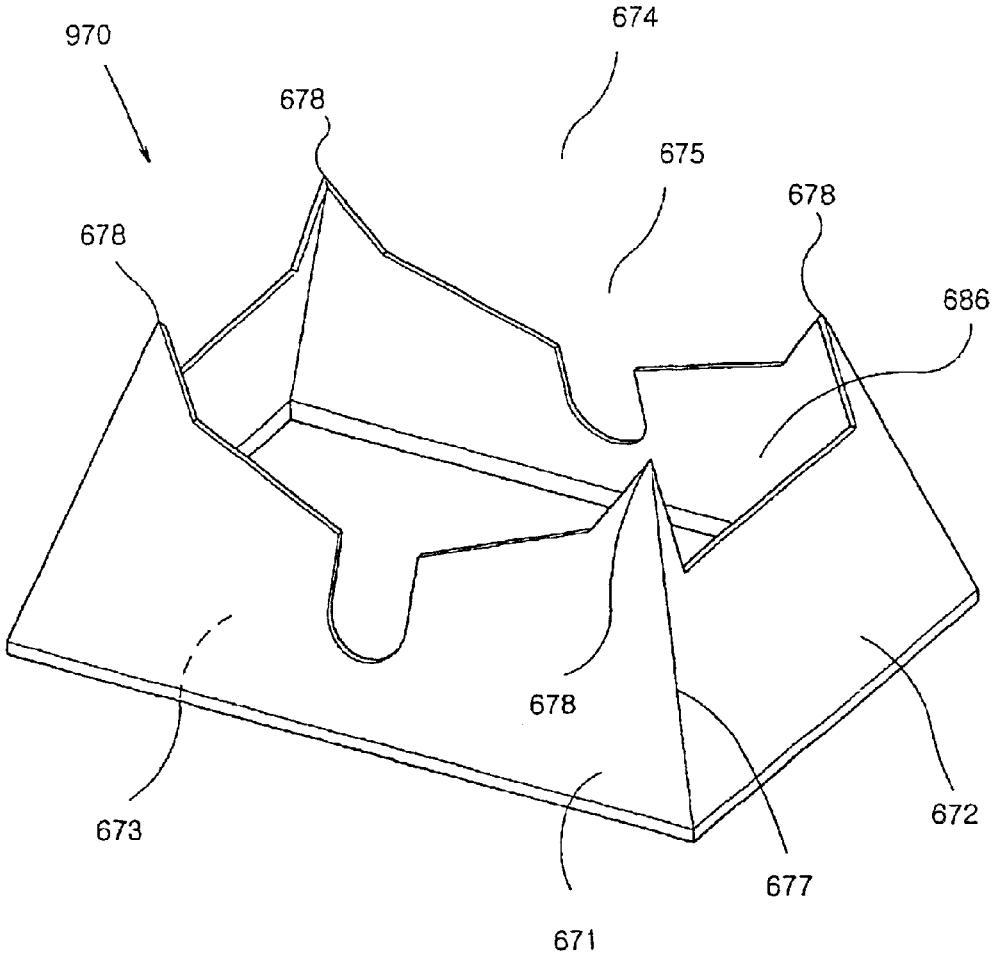
FIG. 8*a* is a diagram illustrating an inner shield for color cathode ray tube according to the fourth preferred embodiment of the present invention.
Figure 8B:
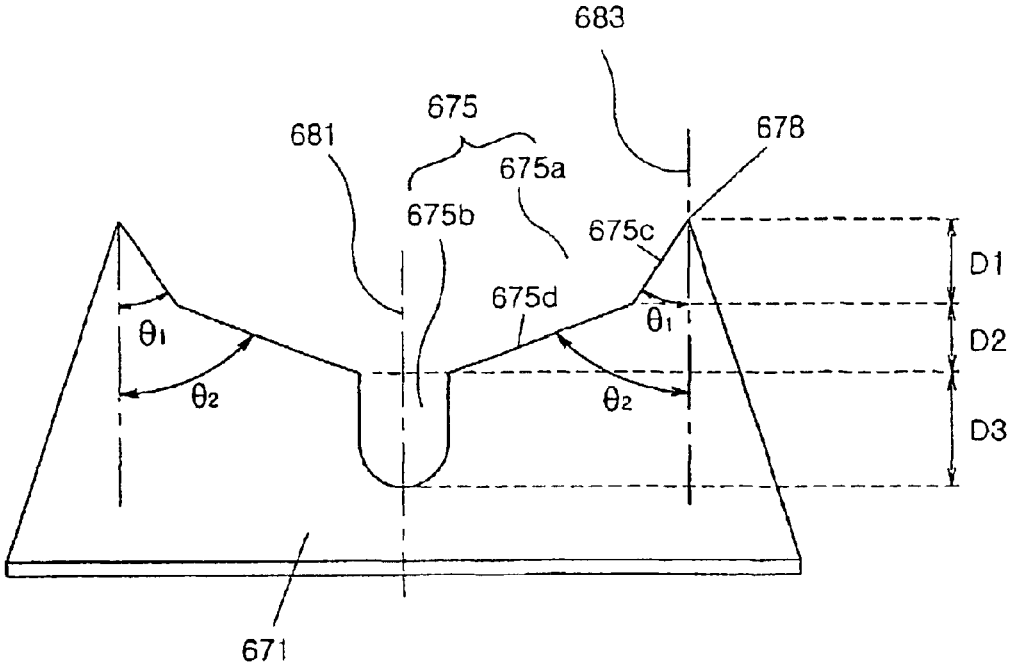
FIG. 8*b* is a diagram illustrating a long side part of the inner shield of FIG. 8*a*.
Figure 8C:
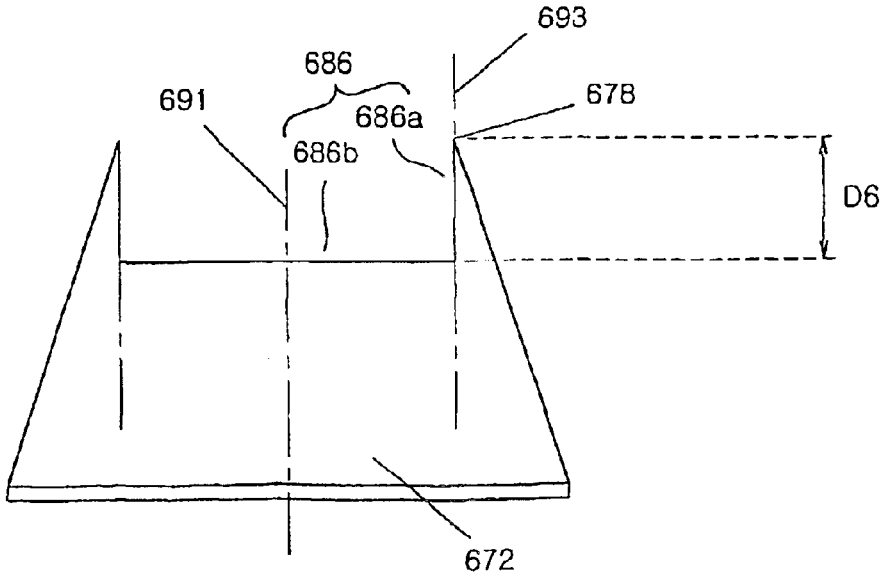
FIG. 8*c* is a diagram illustrating a short side part of the inner shield of FIG. 8*a*.

FIG. 8*a* is a diagram illustrating an inner shield for color cathode ray tube according to the fourth preferred embodiment of the present invention. FIG. 8*b* is a diagram illustrating a long side part of the inner shield of FIG. 8*a*. FIG. 8*c* is a diagram illustrating a short side part of the inner shield of FIG. 5*a*. The same codes are assigned to the parts that are same as those in the first preferred embodiment of the present invention in their structures and functions.

Referring to FIG. 8*a*, FIG. 8*b* and FIG. 8*c*, the inner shield 970 according to the fourth preferred embodiment of the present invention has the recessed part 686 modified from the short side part 672's recessed part 676 of the first preferred embodiment of the present invention and has the same recessed part 675 of the long side part 671 as the first preferred embodiment of the present invention. The recessed part 686 of the short side part 672 is composed of the third recessed part 686*a* and the fourth recessed part 686*b*. The third recessed part 686*a* is recessed for the sixth depth $D_6$ at the third slope from the four points 678 of the short side part 672 at the small opening part 674's side towards the large opening part 673 of the relevant short side part 672. The fourth recessed part 686*b* is recessed at the fourth slope 0 in connection with the third recessed part 686*a*.

Here, the third and fourth slope is the absolute value of the ratio of the length of the third and fourth recessed part 686*a*, 686*b* from the relevant point 678 at the right angle to the short side part 672's center axis 691 i.e., the horizontal component of the third and fourth inclined part to the length of the third and fourth inclined part 686*a*, 686*b* in the direction parallel to the short side part 672's center axis 691 i.e., the vertical component of the third and fourth inclined part. The third slope of the third recessed part 686*a* has the infinite value. The angle of the third recessed part 686*a* is 0 degree in the figure. The angle of 0 degree is the angle with respect to the axis 693 at the points 678 of the short side parts 672. Here, it is preferable that the depth of the short side part 672's recessed part 686 i.e., the sixth depth $D_6$ is in the range of 20 to 40% of the height of the short side part 672.

On the other hand, the recessed part 675 of the long side part 671 is composed of the first recessed part 675*a* including the first and second inclined parts 675*c*, 675*d* and the second recessed part 675*b*. The first recessed part 675*a* and the second recessed part 675*b* are structured in the same way as the first and second recessed parts of the first preferred embodiment of the present invention. In order to avoid repetitious explanation, the detailed explanation of the recessed part 675 is omitted in this section. In the figure, only the recessed part 675 is illustrated for the convenience of the explanation. However, it is apparent that the recessed parts 685, 695 of the second and third preferred embodiment of the present invention may be adopted instead of the recessed part 675.

Figure 9A:
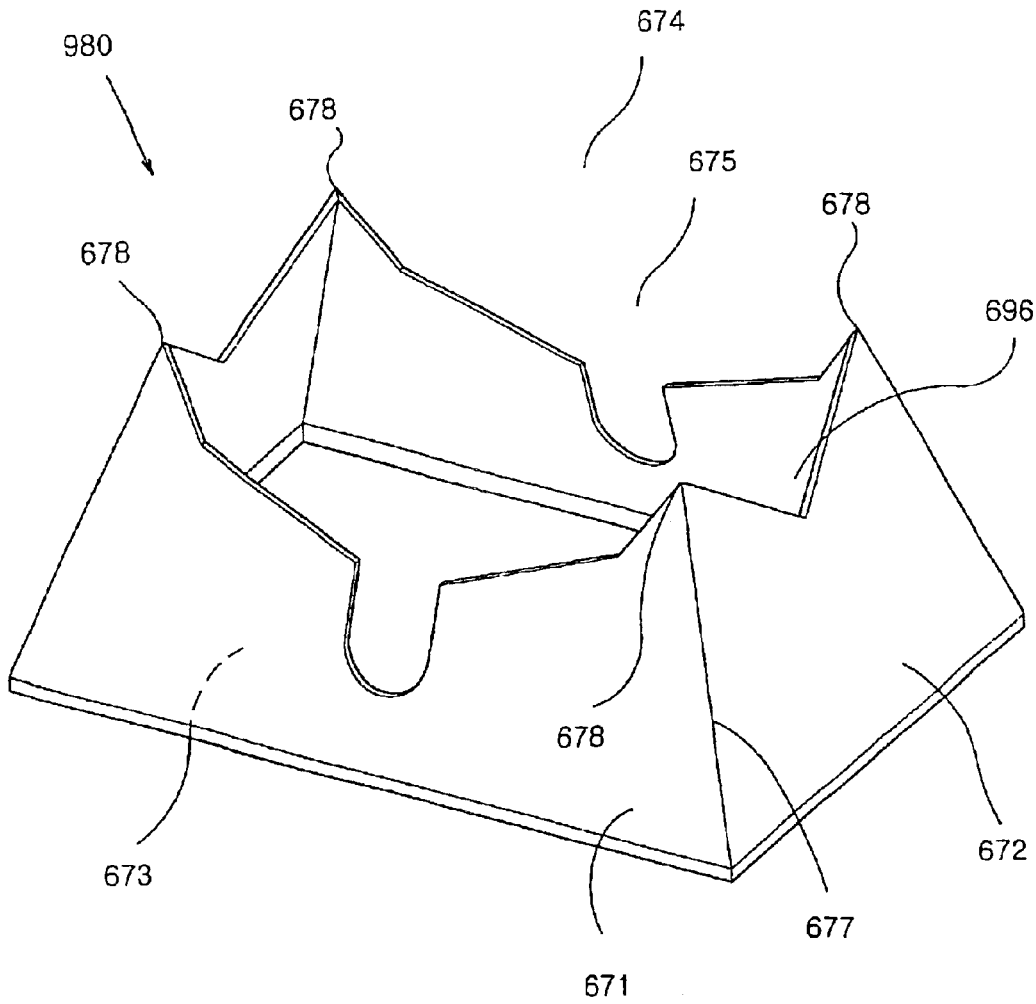
FIG. 9*a* is a diagram illustrating an inner shield for color cathode ray tube according to the fifth preferred embodiment of the present invention.
Figure 9B:
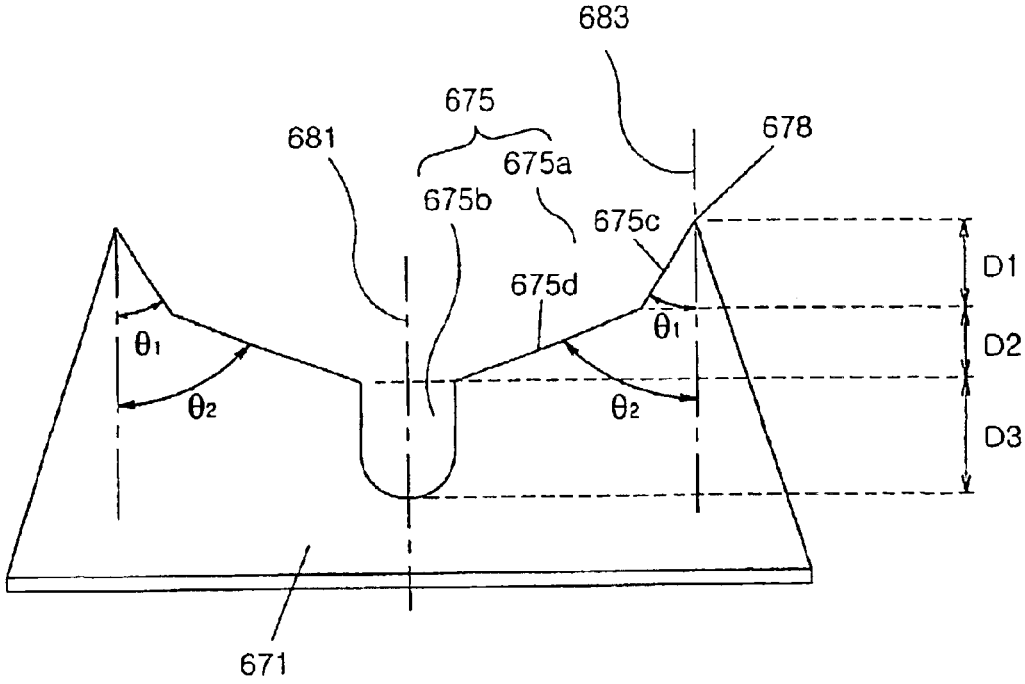
FIG. 9*b* is a diagram illustrating a long side part of the inner shield of FIG. 9*a*.
Figure 9C:
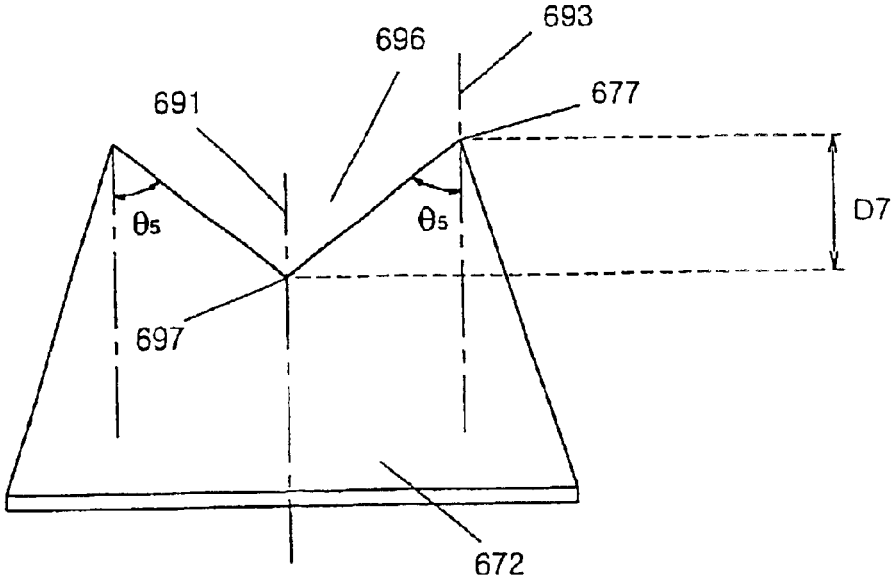
FIG. 9*c* is a diagram illustrating a short side part of the inner shield of FIG. 9*a*.

FIG. 9*a* is a diagram illustrating an inner shield for color cathode ray tube according to the fifth preferred embodiment of the present invention. FIG. 9*b* is a diagram illustrating a long side part of the inner shield of FIG. 9*a*. FIG. 9*c* is a diagram illustrating a short side part of the inner shield of FIG. 9*a*. The same codes are assigned to the parts that are same as those in the first preferred embodiment of the present invention in their structures and functions.

Referring to FIG. 9*a*, FIG. 9*b* and FIG. 9*c*, the inner shield 980 according to the fifth preferred embodiment of the present invention has the third recessed part 696 modified from the short side part 672's recessed part 676 of the first preferred embodiment of the present invention and has the same recessed part 675 of the long side part 671 as the first preferred embodiment of the present invention. The third recessed part 696 of the short side part 672 is recessed for the seventh depth $D_7$ at the third slope from the four points 678 of the short side part 672 at the small opening part 674's side towards the large opening part 673 of the relevant short side part 672, thus creating the V-shape. The third recessed part 696 at the large opening part 673's side has a sharp point. Here, the V-shape third recessed part 696 is created in order to concentrate more magnetic flux at the corner parts 671 than at the short side parts 672.

Here, the third slope is the absolute value of the ratio of the length of the third recessed part 696 from the relevant point 678 at the right angle to the short side part 672's center axis 691 i.e., the horizontal component of the third inclined part to the length of the third recessed part 696 in the direction 693 parallel to the short side part 672's center axis 691 i.e., the vertical element of the third inclined part. The angle $\theta_5$ is the angle with respect to the axis 693 at the points 678. Here, it is preferable that the depth of the short side part 672's recessed part 696 i.e., the seventh depth $D_7$ is in the range of 20 to 40% of the height of the short side part 672.

On the other hand, the recessed part 675 of the long side part 671 is composed of the first recessed part 675*a* including the first and second inclined parts 675*c*, 675*d* and the second recessed part 675*b*. The first recessed part 675*a* and the second recessed part 675*b* are structured in the same way as the first and second recessed parts of the first preferred embodiment of the present invention. In order to avoid repetitious explanation, the detailed explanation of the recessed part 675 is omitted in this section. In the figure, only the recessed part 675 is illustrated for the convenience of the explanation. However, it is apparent that the recessed parts 685, 695 of the second and third preferred embodiment of the present invention may be adopted instead of the recessed part 675.

Figure 10A:
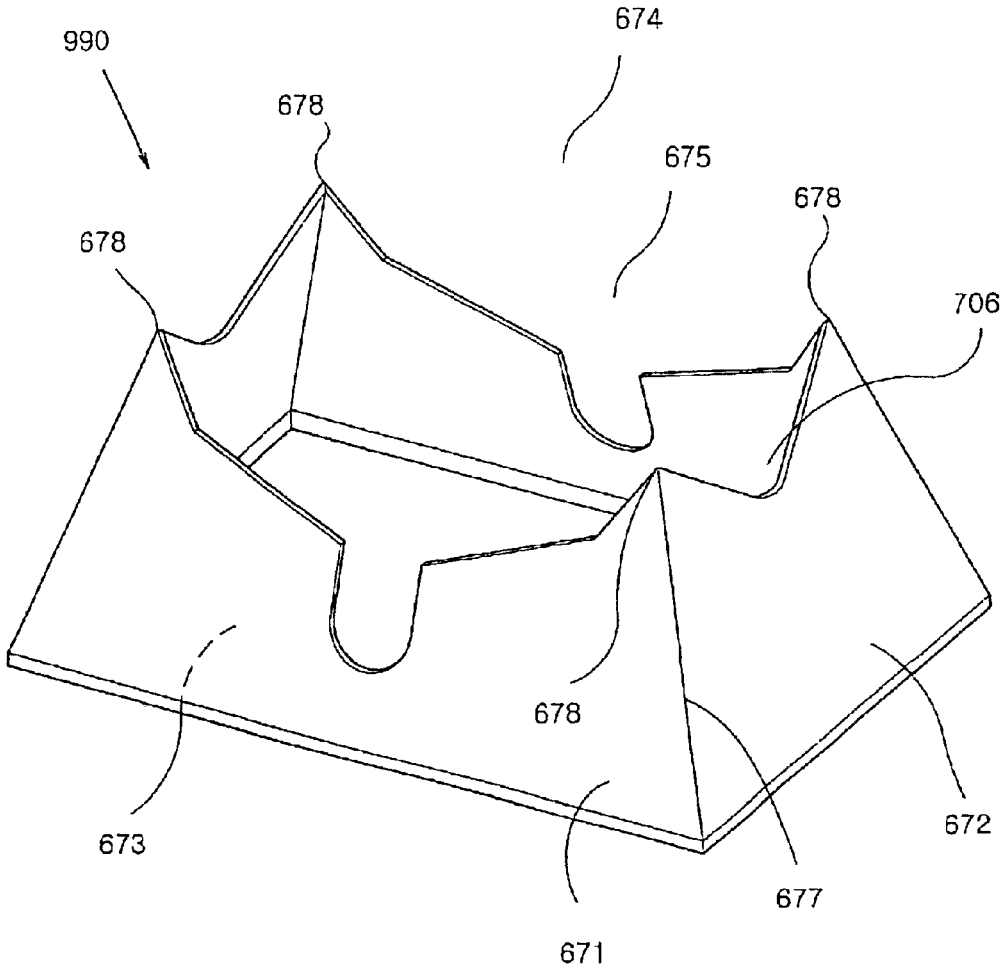
FIG. 10*a* is a diagram illustrating an inner shield for color cathode ray tube according to the sixth preferred embodiment of the present invention.
Figure 10B:
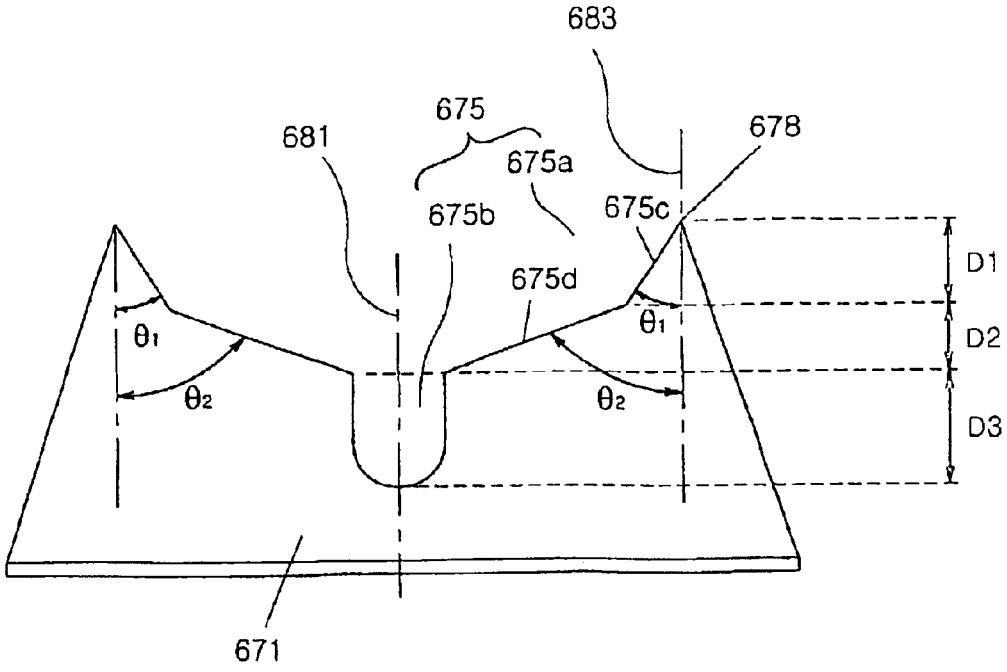
FIG. 10*b* is a diagram illustrating a long side part of the inner shield of FIG. 10*a*.
Figure 10C:
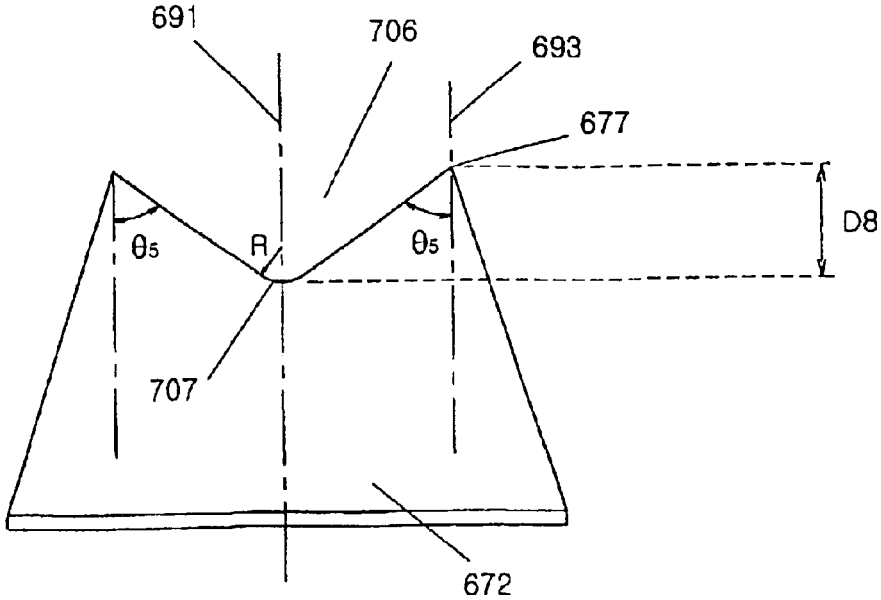
FIG. 10*c* is a diagram illustrating a short side part of the inner shield of FIG. 10*a*.

FIG. 10*a* is a diagram illustrating an inner shield for color cathode ray tube according to the sixth preferred embodiment of the present invention. FIG. 10*b* is a diagram illustrating a long side part of the inner shield of FIG. 10*a*. FIG. 10*c* is a diagram illustrating a short side part of the inner shield of FIG. 9*a*. The same codes are assigned to the parts that are same as those in the fifth preferred embodiment of the present invention in their structures and functions.

Referring to FIG. 10*a*, FIG. 10*b* and FIG. 10*c*, the inner shield 990 according to the sixth preferred embodiment of the present invention has the third recessed part 706 modified from the short side part 672's third recessed part 696 of the fifth preferred embodiment of the present invention and has the same recessed part 675 of the long side part 671 as the first preferred embodiment of the present invention. The third recessed part 706 of the short side part 672 is recessed for the eighth depth $D_5$ at the third slope from the four points 678 of the short side part 672 at the small opening part 674's side towards the large opening part 673 of the relevant short side part 672, thus creating the V-shape.

Here, the third slope is the absolute value of the ratio of the length of the third recessed part 706 at the right angle to the short side part 672's center axis 691 i.e., the horizontal component of the third inclined part to the length of the third recessed part 706 in the direction parallel to the short side part 672's center axis 691 i.e., the vertical component of the third inclined part. The angle $\theta_5$ is the angle with respect to the axis 693 at the points 678. Here, it is preferable that the depth of the short side part 672's recessed part 706 i.e., the eighth depth $D_8$ is in the range of 20 to 40% of the height of the short side part 672.

Although the principle that magnetic flux concentrates on the pointed or sharp angled part was applied in the third recessed part 706, it is difficult to successfully form the pointed part 697 of the fifth preferred embodiment of the present invention at the time of manufacturing an inner shield. Furthermore, even if the pointed part is successfully formed, the pointed part may easily be bent or folded during the mass production. Thus, in order to improve the work efficiency, it is preferable to modify the pointed part 697 to become a rounded pointed part 707 with a certain curvature R.

On the other hand, the recessed part 675 of the long side part 671 is composed of the first recessed part 675*a* including the first and second inclined parts 675*c*, 675*d* and the second recessed part 675*b*. The first recessed part 675*a* and the said second recessed part 675*b* are structured in the same way as the first and second recessed parts of the first preferred embodiment of the present invention. In order to avoid repetitious explanation, the detailed explanation of the recessed part 675 is omitted in this section. In the figure, only the recessed part 675 is illustrated for the convenience of the explanation. However, it is apparent that the recessed parts 685, 695 of the second and third preferred embodiment of the present invention may be adopted instead of the recessed part 675.

As described above, the inner shields according to the fourth, fifth and sixth embodiment of the present invention contain the V-shape recess in the short side part at the small opening part's side. As a result, such inner shields may cause unwanted magnetic field arising from the terrestrial magnetism or external circuits to concentrate at the long side parts and corner parts rather than at the short side parts. Therefore, the unwanted magnetic field arising from the terrestrial magnetism or external circuits may sufficiently be shielded within the electron beams' passing zone in the inner shield.

For the examination of the characteristics of the inner shield according to the present invention, among the various inner shields described above, the one with the long side part's recessed part having the U-shape second recessed part and the short side part's recessed part of the V-shape was selected. Then, a color cathode ray tube adopting the selected inner shield was manufactured and the changes in the landing of three electron beams red, blue and green were measured in the case that the said tube was turned to the southern, northern and western directions respectively.

In other words, in the case of the northern turn, red, blue and green electronic beams' landing changes were measured horizontally H and vertically V at the top-left position TL, top-right position TR, top-center position TC, bottom-left position BL, bottom-right position BR, bottom-center position BC, middle-left position ML and middle-right position MR. Also, the landing changes of competitors' inner shields A, B and C were measured in the same way. The results of the foregoing measurement are illustrated in FIG. 11.

In the case of the southern turn, red, blue and green electron beams' landing changes were measured horizontally H and vertically V at the top-left position TL, top-right position TR, top-center position TC, bottom-left position BL, bottom-right position BR, bottom-center position BC, middle-left position ML and middle-right position MR. Also, the landing changes of competitors' inner shields A, B and C were measured in the same way. The results of the foregoing measurement are illustrated in FIG. 12.

Furthermore, in the case of the western turn, red, blue and green electronic beams' landing changes were measured horizontally H and vertically, V at the top-left position TL, top-right position TR, top-center position TC, bottom-left position BL, bottom-right position BR, bottom-center position BC, middle-left position ML and middle-right position MR. Also, the landing changes of competitors' inner shields A, B and C were measured in the same way. The results of the foregoing measurement are illustrated in FIG. 13.

As shown in FIG. 11, FIG. 12, and FIG. 13, the inner shield I according to the present invention has the superior characteristics to the conventional competitors' inner shields A, B and C.

Resultantly, in the inner shield according to the present invention, the unwanted magnetic field arising from the terrestrial magnetism or external circuits may be concentrated at the long side parts and corner parts rather than at the short side parts. Therefore, the unwanted magnetic field arising from the terrestrial magnetism or external circuits may sufficiently be shielded within the electron beams' passing zone in the inner shield of the present invention.

Consequently, the present invention may prevent miss-landing by reducing the electron beams' break-away from the normal tracks. Furthermore, the degradation of the color purity may be prevented and thus the high-quality images may be obtained.

INDUSTRIAL APPLICABILITY

As explained above, the inner shield for color cathode ray tube according to the present invention comprises a recessed part with one or more inclined parts and a U-shape recessed part at the small opening part's side of the long side part. Furthermore, at the small opening part's side of the short side part, a V-shape recessed part is formed.

As a result, more magnetic flux is concentrated at the long side parts and corner parts than at the short side parts. Thus, red, blue and green electron beams may sufficiently be shielded from the unwanted magnetic field arising from the terrestrial magnetism or external circuits. Accordingly, miss-landing is prevented and, furthermore, the color purity degradation is prevented and the high-quality images may be obtained.

The present invention is not limited to the attached drawings and detailed description of the present invention set forth above. Rather, it is apparent to the persons with ordinary knowledge in the relevant field that the present invention may be modified and changed in various manners within the extent not exceeding the essence of the present invention claimed in the following claims.

What is claimed is:

1. An inner shield for color cathode ray tube, composed of two long side parts facing each other and two short side parts facing each other, which form a small opening part at an electron gun's side and a large opening part at a panel's side, comprising:

a plurality of first recessed parts recessed for a given depth at one or more slopes from each of diagonal points of said long side parts at a small opening part's side towards a large opening part's side of said long side parts; and a plurality of second recessed parts recessed for a given depth in a round shape in connection with said first recessed parts, wherein said slopes are corresponding to the ratio of a length of said first recessed parts in the direction of center axis of said long side parts to a length of said first recessed parts at the right angle to center axis of said long side parts, and wherein an absolute value of said slopes become smaller as said first recessed parts become far from said small opening part's side of said long side parts and close to said large opening part's side of said long side parts.

2. An inner shield for color cathode ray tube, composed of two long side parts facing each other and two short side parts facing each other, which form a small opening part at a electron gun's side and a large opening part at a panel's side, comprising:

a plurality of first recessed parts recessed for a given depth at one or more slopes from each of diagonal points of said long side parts at a small opening part's side towards a large opening part's side of said long side parts; and a plurality of second recessed parts recessed for a given depth in a round shape in connection with said first recessed parts, wherein said slopes are corresponding to the ratio of a length of said first recessed parts in the direction of center axis of said long side parts to a length of said first recessed parts at the right angle to center axis of said long side parts, and wherein each of said first recessed parts comprises a first inclined part with a first slope and a second inclined part with a second slope, an absolute value of said second slope is smaller than that of said first slope.

3. The inner shield according to claim 2, wherein said first slope of said first inclined part has an infinite value.

4. The inner shield according to claim 1, wherein said second recessed parts are in a U-shape.

5. The inner shield according to claim 1, comprising:

a plurality of third recessed parts recessed for a given depth at a third slope from each of diagonal points of said short side parts at said small opening part's side towards said large opening part's side of said short side parts, wherein said third slope is the ratio of a length of said third recessed part in the direction of center axis of said short side parts to a length of said third recessed part at the right angle to center axis of said short side parts; and a plurality of fourth recessed parts recessed at a fourth slope of 0 in connection with said third recessed parts, wherein said third and fourth slopes are ratios of a length of said third and fourth recessed parts in the direction of center axis of said short side parts to a length of said third and fourth recessed parts at the right angle to center axis of said short side parts.

6. The inner shield according to claim 5, wherein said third slope of said third recessed parts has an infinite value.

7. The inner shield according to claim 2, comprising:

a plurality of third recessed parts recessed for a given depth at a third slope from each of diagonal points of said short side parts at said small opening part's side towards said large opening part's side of said short side parts, wherein said third slope is the ratio of a length of said third recessed part in the direction of center axis of said short side parts to a length of said third recessed part at the right angle to center axis of said short side parts; and a plurality of fourth recessed parts recessed at a fourth slope of 0 in connection with said third recessed parts, wherein said third and fourth slopes are ratios of a length of said third and fourth recessed parts in the direction of center axis of said short side parts to a length of said third and fourth recessed parts at the right angle to center axis of said short side parts.

8. The inner shield according to claim 7, wherein said third slope of said third recessed parts has an infinite value.

9. The inner shield according to claim 3, comprising:

a plurality of third recessed parts recessed for a given depth at a third slope from each of diagonal points of said short side parts at said small opening part's side towards said large opening part's side of said short side parts, wherein said third slope is the ratio of a length of said third recessed part in the direction of center axis of said short side parts to a length of said third recessed part at the right angle to center axis of said short side parts; and a plurality of fourth recessed parts recessed at a fourth slope of 0 in connection with said third recessed parts, wherein said third and fourth slopes are ratios of a length of said third and fourth recessed parts in the direction of center axis of said short side parts to a length of said third and fourth recessed parts at the right angle to center axis of said short side parts.

10. The inner shield according to claim 9, wherein said third slope of said third recessed parts has an infinite value.

11. The inner shield according to claim 4, comprising:

a plurality of third recessed parts recessed for a given depth at a third slope from each of diagonal points of said short side parts at said small opening part's side towards said large opening part's side of said short side parts, wherein said third slope is the ratio of a length of said third recessed part in the direction of center axis of said short side parts to a length of said third recessed part at the right angle to center axis of said short side parts; and a plurality of fourth recessed parts recessed at a fourth slope of 0 in connection with said third recessed parts, wherein said third and fourth slopes are ratios of a length of said third and fourth recessed parts in the direction of center axis of said short side parts to a length of said third and fourth recessed parts at the right angle to center axis of said short side parts.

12. The inner shield according to claim 11, wherein said third slope of said third recessed parts has an infinite value.

13. The inner shield according to claim 1, comprising said third recessed parts recessed in a V-shape from each of diagonal points of said short side parts at said small opening part's side towards said short side part's large opening part's side.

14. The inner shield according to claim 13, wherein each of pointed parts of said third recessed parts at said large opening part's side has a given curvature.

15. The inner shield according to claim 2, comprising said third recessed parts recessed in a V-shape from each of diagonal points of said short side parts at said small opening part's side towards said short side part's large opening part's side.

16. The inner shield according to claim 15, wherein each of pointed parts of said third recessed parts at said large opening part's side has a given curvature.

17. The inner shield according to claim 3, comprising said third recessed parts recessed in a V-shape from each of diagonal points of said short side parts at said small opening part's side towards said short side part's large opening part's side.

18. The inner shield according to claim 17, wherein each of pointed parts of said third recessed parts at said large opening part's side has a given curvature.

19. The inner shield according to claim 4, comprising said third recessed parts recessed in a V-shape from each of diagonal points of said short side parts at said small opening part's side towards said short side part's large opening part's side.

20. The inner shield according to claim 19, wherein each of pointed parts of said third recessed parts at said large opening part's side has a given curvature.

21. The inner shield according to claim 2, wherein said second recessed parts are in a U-shape.

22. The inner shield according to claim 21, comprising:

a plurality of third recessed parts recessed for a given depth at a third slope from each of diagonal points of said short side parts at said small opening part's side towards said large opening part's side of said short side parts, wherein said third slope is the ratio of a length of said third recessed part in the direction of center axis of said short side parts to a length of said third recessed part at the right angle to center axis of said short side parts; and a plurality of fourth recessed parts recessed at a fourth slope of 0 in connection with said third recessed parts, wherein said third and fourth slopes are ratios of a length of said third and fourth recessed parts in the direction of center axis of said short side parts to a length of said third and fourth recessed parts at the right angle to center axis of said short side parts.

23. The inner shield according to claim 22, wherein said third slope of said third recessed parts has an infinite value.

24. The inner shield according to claim 21, comprising said third recessed parts recessed in a V-shape from each of diagonal points of said short side parts at said small opening part's side towards said short side part's large opening part's side.

25. The inner shield according to claim 24, wherein each of pointed parts of said third recessed parts at said large opening part's side has a given curvature.

* * * * *